United States Patent [19]

Shimba et al.

[11] Patent Number: 4,666,825

[45] Date of Patent: May 19, 1987

[54] METHOD FOR THE PROCESSING OF SILVER HALIDE PHOTOGRAPHIC LIGHT-SENSITIVE MATERIALS

[75] Inventors: Satoru Shimba; Masao Iwamuro; Kenji Ito; Katutoyo Suzuki; Fumio Hamada, all of Hino, Japan

[73] Assignee: Konishiroku Photo Industry Co., Ltd., Tokyo, Japan

[21] Appl. No.: 837,580

[22] Filed: Mar. 4, 1986

Related U.S. Application Data

[63] Continuation of Ser. No. 768,917, Aug. 22, 1985, abandoned, which is a continuation of Ser. No. 578,662, Feb. 9, 1984, abandoned.

[30] Foreign Application Priority Data

Feb. 16, 1983 [JP] Japan ..... 58-25098

[51] Int. Cl.[4] ..... G03C 1/40; G03C 5/38; G03C 7/34; G03C 7/42

[52] U.S. Cl. ..... 430/385; 430/384; 430/393; 430/551; 430/552; 430/553

[58] Field of Search ..... 430/384, 385, 393, 552, 430/553

[56] References Cited

U.S. PATENT DOCUMENTS

| | | | |
|---|---|---|---|
| 4,333,999 | 6/1982 | Lau | 430/553 |
| 4,427,767 | 1/1984 | Aoki et al. | 430/553 |
| 4,434,225 | 2/1984 | Sugita et al. | 430/553 |
| 4,443,536 | 4/1984 | Lestina | 430/553 |
| 4,444,872 | 4/1984 | Kato et al. | 430/384 |
| 4,446,226 | 5/1984 | Yamashita et al. | 430/567 |
| 4,450,228 | 5/1984 | Shimba et al. | 430/553 |
| 4,451,558 | 5/1984 | Sugita et al. | 430/553 |
| 4,451,559 | 8/1984 | Sato et al. | 430/558 |
| 4,458,012 | 7/1984 | Ito et al. | 430/553 |

*Primary Examiner*—Richard L. Schilling
*Attorney, Agent, or Firm*—Jordan B. Bierman

[57] ABSTRACT

A method for processing silver halide photographic light-sensitive material which comprises color developing an imagewise-exposed silver halide photographic light-sensitive material and then bleach-fixing said color developed light-sensitive material, said light-sensitive material comprising support having thereon a silver halide emulsion layer containing monodispersed silver halide particles and a photographic cyan coupler having the Formula [I]:

Formula [I]

wherein X is a hydrogen atom or a radical that can be split off by the reaction of said coupler with the oxidized product of an aromatic primary amine color developing agent; $R_1$ is an aryl or a heterocyclic radical; and $R_2$ is a ballasting radical which provides non-diffusibility to said cyan coupler and a cyan dye formed therefrom.

18 Claims, No Drawings

METHOD FOR THE PROCESSING OF SILVER HALIDE PHOTOGRAPHIC LIGHT-SENSITIVE MATERIALS

This application is a continuation of application Ser. No. 768,917 filed Aug. 22, 1985, which is a Rule 62 continuation of Ser. No. 578,662, filed Feb. 9, 1984, which claims the priority of Japanese No. 25,098/83, filed Feb. 16, 1983, both now abandoned.

BACKGROUND OF THE INVENTION

1. Industrially Applicable Field

The present invention relates to a method for the processing of silver halide photographic light-sensitive materials, and more particularly to a bleach-fix monobath processing, which is required for the purpose of the rapid processing of high-speed silver halide color photographic light-sensitive materials.

2. Description of the Prior Art

Present-day silver halide photographic light-sensitive materials are desired to have higher light-sensitivity and more improved image quality. In order to obtain a higher sensitivity various endeavors have hitherto been made in the aspects of the formation of silver halide particles, silver halide composition, chemical sensitization, spectral sensitization, and the like, and these have fairly succeeded to date. However, even if all the known methods of increasing the sensitivity were used, those obtained in color light-sensitive materials would still not be sufficient. Another effective method for increasing the sensitivity of silver halide color photographic light-sensitive materials is to make larger the silver halide particle size. However, this method increases the sensitivity all right, but deteriorates image quality, particularly, the graininess and sharpness. The graininess of the finally obtained color image in color light-sensitive materials is affected not only by the graininess of the silver image but by the developing agent and coupler used, and other materials present along therewith. Effective methods for improving the image quality, particularly, the graininess and sharpness, of a color light-sensitive material include increasing the quantity of silver; using development inhibitor releasing-type couplers (generally called DIR couplers) or noncoupler-type development inhibitor compounds; and composing each of the blue-sensitive, green-sensitive, and red-sensitive layers of not less than two subcomponent layers different in the mean silver halide particle size. However, the color light-sensitive material having blue-sensitive, green-sensitive and red-sensitive layers, to which are applied such methods, has produced, in addition to the problem of the image quality such as the graininess and sharpness, new difficulties that have not ever seen before in relatively low-speed color light-sensitive materials. The difficulties are such problems that there occur increases in the mean silver halide particle size and in the coating quantity of silver for the purpose of the higher sensitization and the improvement on the image quality; an increase in the layer thickness due to the respective light-sensitive layer compositions each being of not less than two subcomponent layers; and dye loss and large deterioration of the desilvering due to the use of DIR couplers or DIR compounds.

Particularly, in the above-described color light-sensitive material, the dye loss and the desilverying characteristic during the bleaching process of the red-sensitive silver halide emulsion layer that is located nearest the support are considerable problems as compared to those of the green-sensitive and blue-sensitive layers.

That is, the above-described points, as well-known to those skilled in the art, are deathblow to the color reproduction obtained after processing the color light-sensitive material, and the slight amount of the residual silver after the processing is said to be detrimental to the preservation of the dye image, thus making it almost impossible to provide any practically usable color light-sensitive materials.

On the other hand, as the bleaching agent for use in removing the silver image from conventional silver halide color photographic light-sensitive materials, there have been used such oxidizing agents as red prussiate of potash, bichromates, persulfates, iron chloride, and the like, but these agents are undesirable in respect of having toxicity and corroding members of the processor used. Therefore these agents are considered unable to be practically satisfactorily used.

In recent years, metallic complex salts of aminopolycarboxylic acids have become used as the oxidizing agent for a bleaching bath or bleach-fix bath for the reason that they have no problem at all in the toxicity.

However, such metallic complex salts of aminopolycarboxylic acids are weak in the oxidizing power, so that they have the disadvantage that the rate of their bleaching of the image silver is low, the disadvantage making it impossible to carry out any monobath bleach-fix processing which is essential for the rapid processing of a high-speed silver halide color photographic light-sensitive material.

In fact, an ethylenediaminetetraacetic acid iron (III) salt which is considered strongest in the bleaching power among the metallic complex salts of aminopolycarboxylic acids is partly used practically also as the bleach-fix bath, but is insufficient in the bleaching power for high-speed silver halide color photographic light-sensitive materials, particularly, those color paper for camera use, color negative and color reversal films for camera use, which all contain silver iodide as their silver halide, and even when these light-sensitive materials are processed over an extensive period, a very slight amount of the image silver remains undesilverized. This phenomenon significantly appears in the case of a bleach-fix bath containing a thiosulfate as the oxidizing agent together with a sulfite because the oxidation-reduction potential is lowered.

In an attempt to solve these problems, as described in Japanese Patent Examined Publication No. 8506/1970, Japanese Patent Publication Open to Public Inspection (hereinafter referred to as Japanese Patent O.P.I. Publication) No. 280/1971, Japanese Patent Examined Publication No. 556/1971 and Japanese Patent O.P.I. Publication No. 5630/1974, bleach accelerators have been used to be added to those bleach-fix baths comprised principally of ethylenediaminetetraacetic acid iron (III) salt, but the use of such bleaching accelerators do not necessarily provide a satisfactory bleaching effect or has such a problem as producing less-soluble precipitates as the silver is dissolved to be accumulated, and the like, so that the accelerator cannot be practically used at all in the bleach-fix bath for high-speed silver halide color photographic light-sensitive materials.

As another method, there is carried out an ethylenediaminetetraacetic acid iron (III)complex salt-containing bleach-fix bath processing at a low pH at which the bleaching power is strongly displayed. In this process, however, there occur such vital problems that the thiosulfate and sulfite present together with the complex salt tend to be decomposed to make the bleach-fix bath unstable, and a cclor developed dye, particularly, cyan dye, tends to become a leuco compound, so that the dye does not sufficiently form its intrinsic color.

In order to solve such problems if the processing is effected at a higher pH, it causes such further disadvantages that, although the occurrence of the leuco compound of the cyan dye becomes reduced, the desilvering ability becomes lowered as the pH increases, and further there appears a dye stain (hereinafter called stain) due to the coupling reaction of the oxidized product of a developing agent with the residual coupler, so that any satisfactory bleach-fix processing cannot be achieved.

As another solution to such problems there is conceivable such a method that into a silver halide color photographic light-sensitive material is incorporated a leuco dye-less-formable coupler, particularly, a 2,5-diacylamino radical-having phenol-type cyan coupler, and this color light-sensitive material is processed in a bleach-fix bath with its pH not more than 5 containing ethylenediaminetetraacetic acid iron (III) complex salt as the oxidizing agent, or in a bleach-fix bath containing glycol-ether diaminetetraacetic acid iron (III) complex salt. However, even if the degree of the formation of the leuco compound of the cyan dye and the bleaching rate were as good as expections, the sulfite and thiosulfate present together would be significantly decomposed in a low-pH bleach-fix bath, making the bath unstable, so that the bleach-fix bath is not usable practically. Therefore, in the case where the bleach-fix processing of high-speed color light-sensitive materials is carried out by use of a conventional ethylenediaminetetraacetic acid iron (III) complex salt as the oxidizing agent-containing bleach-fix bath, there has been no such sufficiently satisfactory bleach-fix bath as improved to solve concurrently the four problems: to increase the desilvering rate and power; to reduce the formation of the leuco compound of the cyan dye; to reduce the occurrence of stain; and to stabilize the bleach-fix bath by preventing the decomposition of, particularly, the thiosulfate.

Accordingly, it has been hoped for the realization of a monobath bleach-fix processing system for use in processing high-speed color light-sensitive materials, which is capable of satisfying concurrently these four problems that are essential for the monobath bleach-fix liquid.

OBJECTS OF THE INVENTION

It is a first object of the present invention to provide a processing method for preventing the occurrence of the leuco compound of the cyan dye in the monobath bleach-fix processing of high-speed silver halide color photographic light-sensitive materials.

It is a second object of the present invention to provide a processing method for improving the desilvering characteristic in the monobath bleach-fix processing of high-speed silver halide color photographic light-sensitive materials.

It is a third object of the present invention to provide a processing method for preventing the occurrence of cyan stain.

DETAILED DESCRIPTION OF THE INVENTION

As a result of having investigated in accordance with the above objects, we have now found that the problems in the objects can be solved by processing a specific silver halide photographic light-sensitive material by use of a specific processing method.

Namely, the above specific silver halide photographic light-sensitive material comprises a support having thereon a silver halide emulsion layer containing monodispersive silver halide particles and a photographic cyan coupler having the following Formula [I].

The above specific processing method is a bleach-fix processing method for use in processing, after imagewise exposing and color-developing, the above silver halide photographic light-sensitive material.

Formula [I]

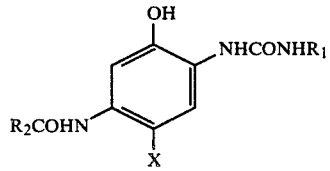

wherein X represents a hydrogen atom or a radical that can be split off by the coupling reaction of the compound with the oxidized product of an aromatic primary amine color developing agent; $R_1$ is an aryl radical (such as phenyl, naphthyl, etc.) or a heterocyclic radical; and $R_2$ is a ballasting radical necessary to provide nondiffusibility to the cyan coupler having Formula [I] and to the cyan dye formed from the same cyan coupler; the $R_1$ being preferably a naphthyl radical or a heterocyclic radical (wherein the carbon atom of the heterocyclic radical is bonded to the nitrogen atom of an ureido radical) or a phenyl radical having at least one substituent selected from the group consisting of trifluoromethyl, nitro, cyano, —COR, —COOR', —$SO_2$R, —$SO_2$OR',

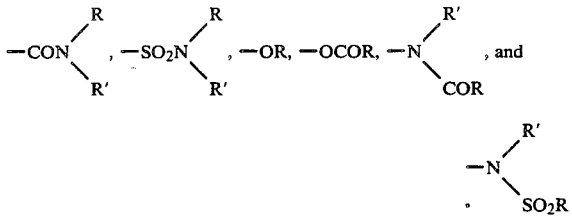

(wherein R is an aliphatic radical or an aromatic radical; R' is a hydrogen atom, an aliphatic radical or an aromatic radical; and the R and R' are allowed to combine with each other to form a cyclic ring).

The preferred cyan couplers having Formula [I] include those having the following Formula [Ia] and those having the following Formula [Ib]:

Formula [Ia]

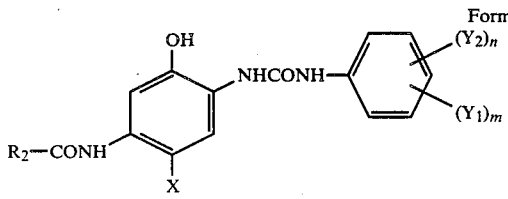

-continued

Formula [Ib]

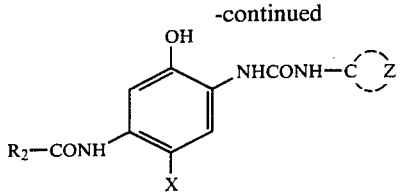

wherein $Y_1$ is trifluoromethyl, nitro, cyano or a radical represented by —COR, —COOR', —$SO_2R$, —$SO_2OR'$,

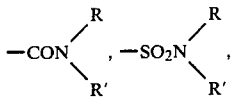

—OR, —OCOR, —NCOR or

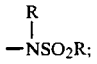

R is an aliphatic radical [preferably an alkyl radical having from 1 to 10 carbon atoms (such as methyl, butyl, cyclohexal, benzyl)] or an aromatic radical; )]; ]preferably phenyl radicals (such as phenyl, tolyl, etc. and R' is a hydrogen atom or the radical as defined in the R, the R and the R' being allowed to combine with each other to form a cyclic ring; $Y_2$ is a monovalent radical and preferably an aliphatic radical [preferably an alkyl radical having from 1 to 10 carbon atoms (such as methyl, t-butyl, ethoxyethyl, cyanomethyl)], an aromatic radical [preferably a phenyl radical (such as phenyl, tolyl), napthyl radical, etc.], a halogen atom (such as fluorine, chlorine, bromine, etc.), an amino radical (such as ethylamino, diethylamino), hydroxy or the substituent as defined in the $Y_1$; m is an integer of from 1 to 3; n is an integer of up to 3; Z is a group of nonmetallic atoms necessary to form a heterocyclic radical or a naphthyl radical, the heterocyclic radical being preferably a 5- or 6-member heterocyclic ring containing from 1 to 4 nitrogen atoms, oxygen atoms or sulfur atoms, and including, e.g., furyl, thienyl, pyridyl, quinolyl, oxazolyl, tetrazolyl, benzothiazolyl, tetrahydrofuranyl, and the like, the said heterocyclic radicals each being allowed to have introduced thereinto an arbitrary substituent such as, e.g., a alkyl radical having from 1 to 10 carbon atoms (such as ethyl, i-propyl, i-butyl, t-butyl, t-octyl, etc.), an aryl radical (such as phenyl, naphthyl), a halogen atom (such as fluorine, chlorine, bromine, etc.), a cyano radical, a nitro radical, a sulfonamido radical (such as methanesulfonamido, butanesulfonamido, p-toluenesulfonamido, etc.), a sulfamoyl radical (such as methylsulfamoyl, phenylsulfamoyl, etc.), a sulfonyl radical (such as methanesulfonyl, p-toluenesulfonyl, etc.), a fluorosulfonyl radical, a carbamoyl radical (such as dimethylcarbamoyl, phenylcarbamoyl, etc.), an oxycarbonyl radical (such as ethoxycarbonyl, phenoxycarbonyl, etc.), an acyl radical (such as acetyl, benzoyl, etc.), a heterocyclic radical (such as pyridyl, pyrazolyl, etc.), an alkoxy radical, an aryloxy radical, an acyloxy radical, or the like; and $R_2$ represents an aliphatic or aromatic radical necessary to provide a nondiffusibility to the cyan coupler having Formula [I] or and to the cyan dye formed from the same coupler, the said aliphatic or aromatic radical being such as, for example, an alkyl radical, an alkenyl radical, a cycloalkyl radical, an aryl radical or a 5- or 6-member heterocyclic radical, each having from 4 to 30 carbon atoms, the said radical including preferably those having the following Formula [I]:

Formula [Ic]

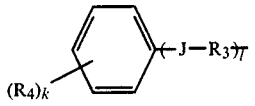

wherein J is an oxygen atom or a sulfur atom; k is an integer of up to 4; l is an integer of 0 or 1; provided when the k is an integer of not less than 2, the not less than two $R_4$s are allowed to be either the same as or different from each other; $R_3$ is a straight-chain or branched-chain alkylene radical having from 1 to 20 carbon atoms; $R_4$ is a monovalent radical such as a halogen atom (preferably chlorine or bromine), an alkyl radical [preferably a straight-chain or branched-chain alkyl radical having from 1 to 20 carbon atoms (such as methyl, tert-butyl, tert-pentyl, tert-octyl, dodecyl, pentadecyl, benzyl, phenethyl)], an aryl radical (such as phenyl), a heterocyclic radical (preferably a nitrogen-containing heterocyclic radical), an alkoxy radical [preferably a straight-chain or branched-chain alkyloxy radical (such as methoxy, ethoxy, tertbutyloxy, octyloxy, decyloxy, dodecyloxy)], an aryloxy radical (such as phenoxy), a hydroxyl radical, an acyloxy radical [preferably an alkylcarbonyloxy radical, an arylcarbonyloxy radical (such as acetoxy, benzyloxy)], a carboxy radical, an alkoxycarbonyl radical (preferably a straight-chain or branched-chain alkyloxycarbonyl radical having from 1 to 20 carbon atoms), an aryloxycarbonyl radical (preferably phenoxycarbonyl), an alkylthio radical (preferably an alkylthio radical having from 1 to 20 carbon atoms), an acyl radical (preferably a straight-chain or branched-chain alkylcarbonyl radical having from 1 to 20 carbon atoms), an acylamino radical (preferably a straight-chain or branched-chain alkylcarbamido radical or benzenecarbamido radical having from 1 to 20 carbon atoms), a sulfonamido radical (preferably a straight-chain or branched-chain alkylsulfonamido radical or benzenesulfonamido radical having from 1 to 20 carbon atoms), a carbamoyl radical (preferably a straight-chain or branched-chain alkylaminocarbonyl or phenylaminocarbonyl radical having from 1 to 20 carbon atoms), a sulfamoyl radical (preferably a straight-chain or branched-chain alkylaminosulfonyl or phenylaminosulfonyl radical having from 1 to 20 carbon atoms), or the like; and X is a hydrogen atom or a radical that can be split off during the coupling reaction of the compound with the oxidized product of a color developing agent, the said radical being such as, e.g., a halogen atom (such as chlorine, bromine, fluorine), an oxygen atom or such a radical to whose coupling position is bonded a nitrogen atom as an aryloxy radical, a carbamoyloxy radical, a carbamoylmethoxy radical, an acyloxy radical, a sulfonamido radical, a succinic acid imido radical, or the like. Further particular examples of the radical represented by the X include those as described in U.S. Pat. No. 3,741,563, Japanese Patent O.P.I. Publication No. 37425/1972, Japanese Patent Examined Publication No. 36894/1973, Japanese Patent O.P.I. Publication Nos. 10135/1975, 117422/1975, 130441/1975, 108841/1976, 120334/1975, 18315/1977 and 105226/1978.

The cyan coupler of the present invention can be easily synthesized by any one of those methods as described in, e.g., U.S. Pat. No. 3,758,308 and Japanese Patent O.P.I. Publication No. 65134/1981.
The following are preferred examples of the compound of the present invention, but the present invention is not limited thereto.
(1)
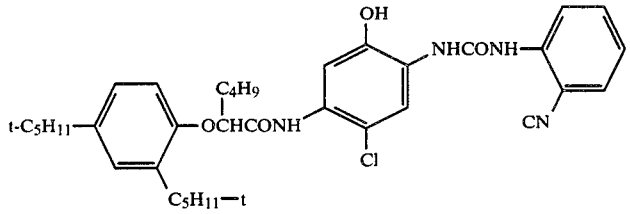
(2)
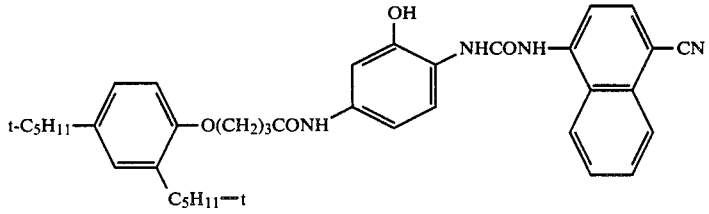
(3)
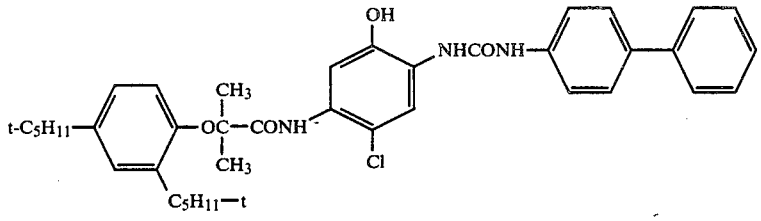
(4)
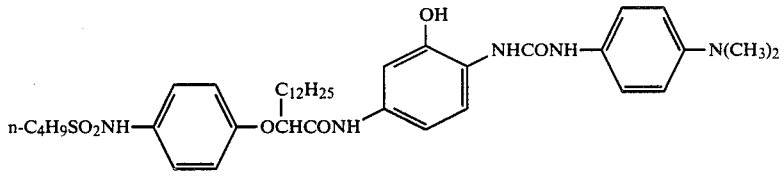
(5)
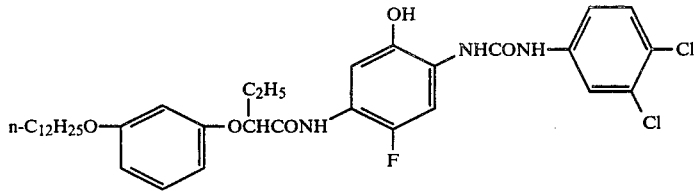
(6)
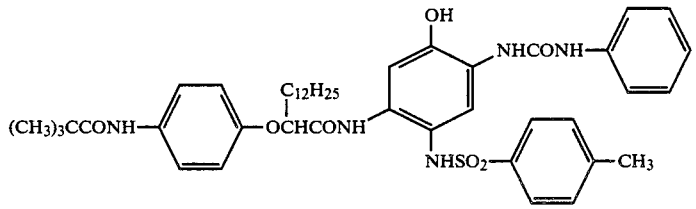
(7)
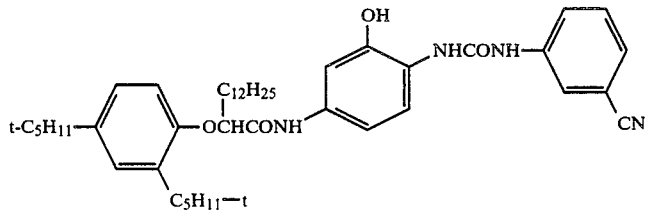

-continued
(8)
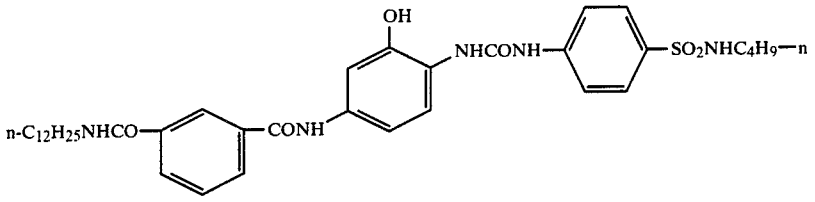
(9)
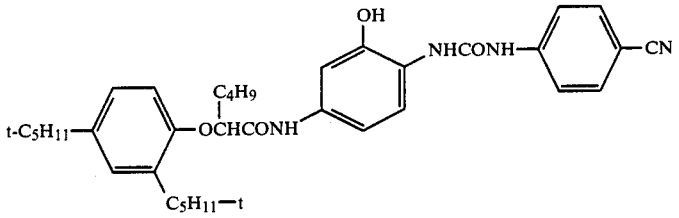
(10)
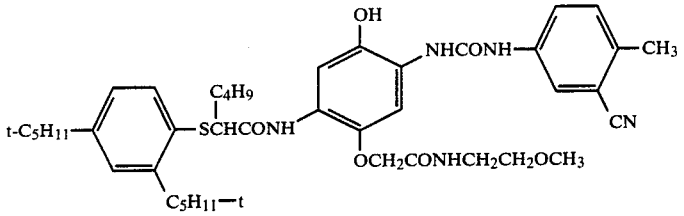
(11)
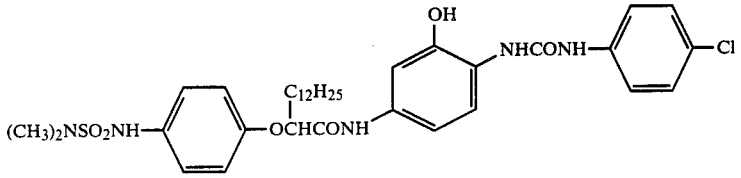
(12)
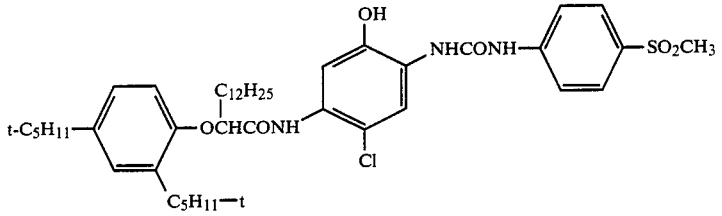
(13)
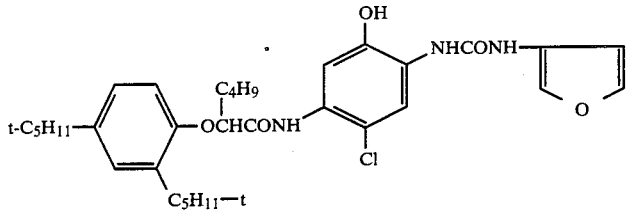
(14)
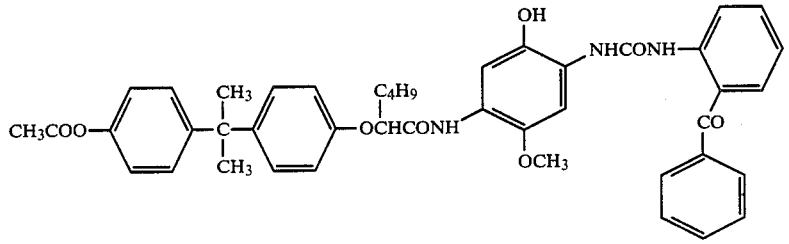

-continued
(15)
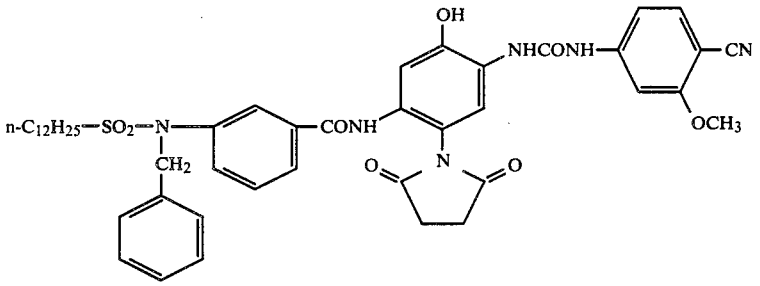
(16)
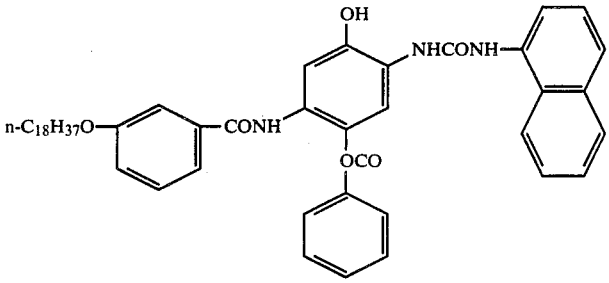
(17)
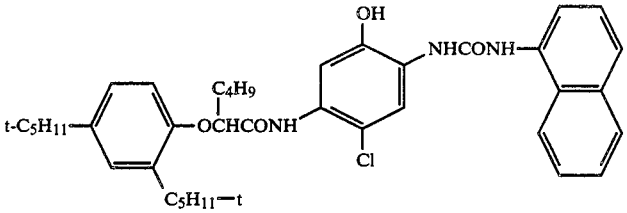
(18)
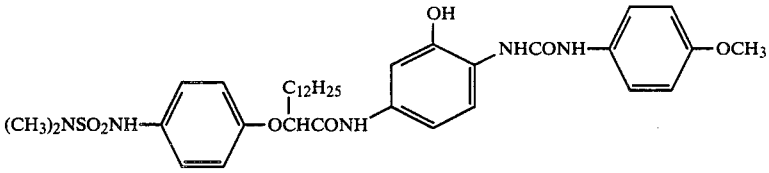
(19)
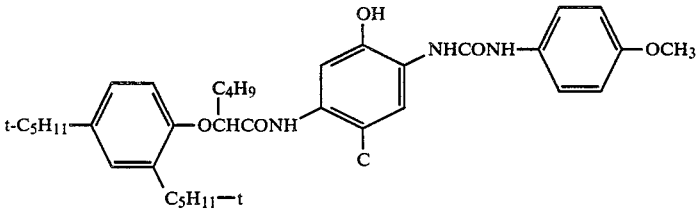
(20)
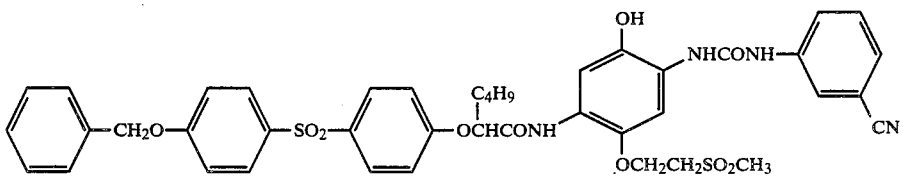
(21)
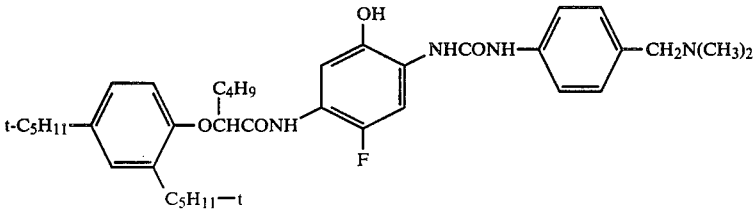

-continued
(22)
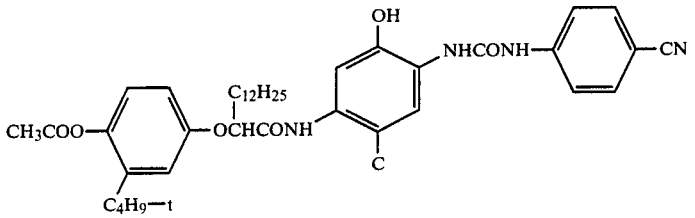
(23)
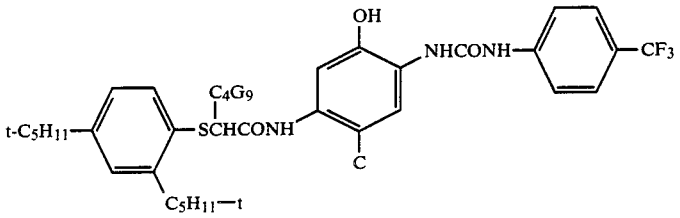
(24)
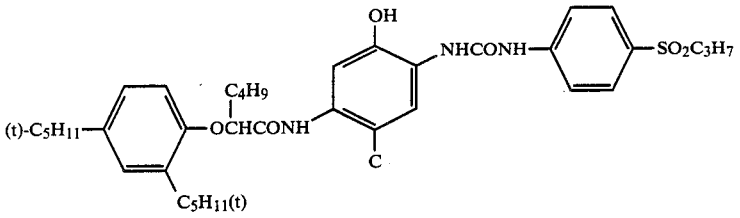
(25)
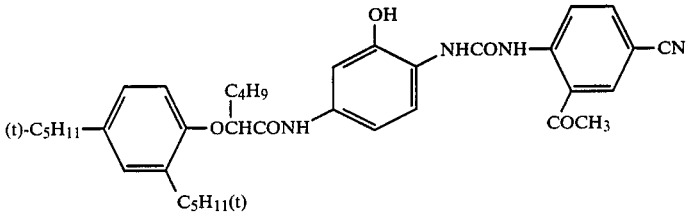
(26)
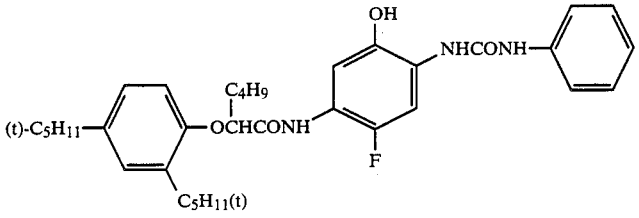
(27)
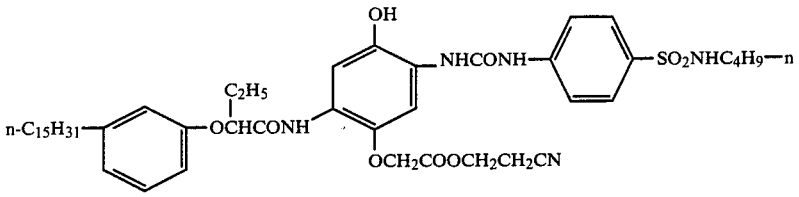
(28)
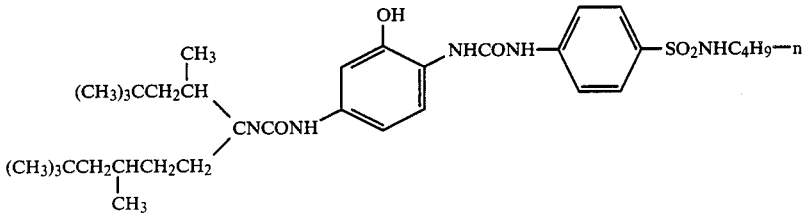

-continued
(29)
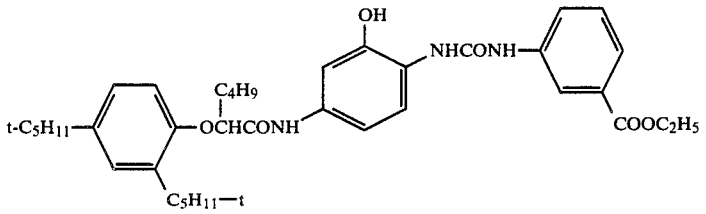
(30)
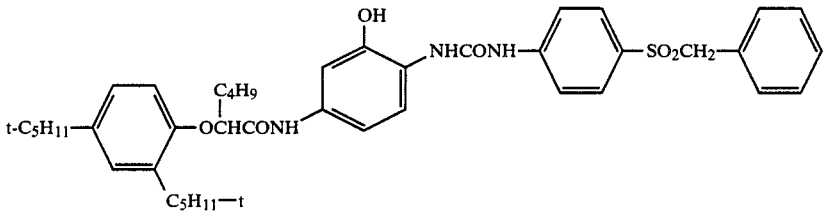
(31)
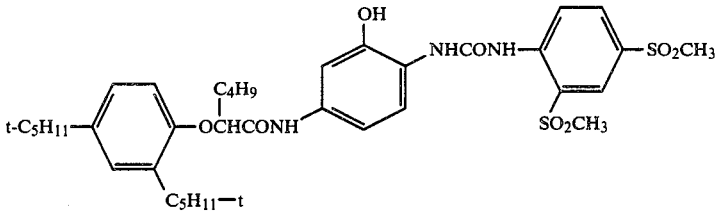
(32)
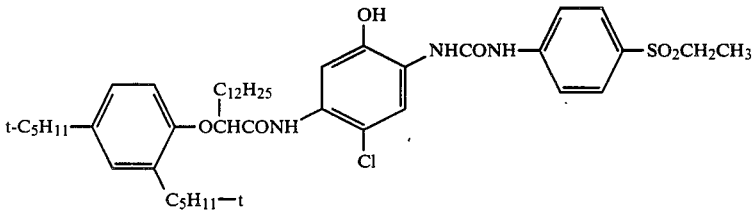
(33)
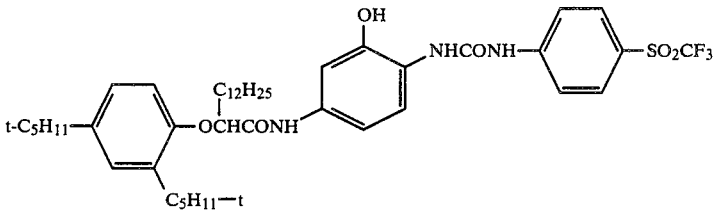
(34)
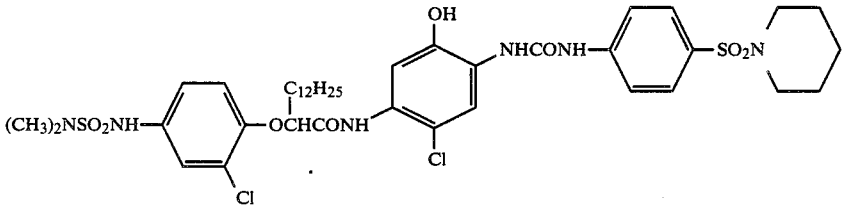
(35)
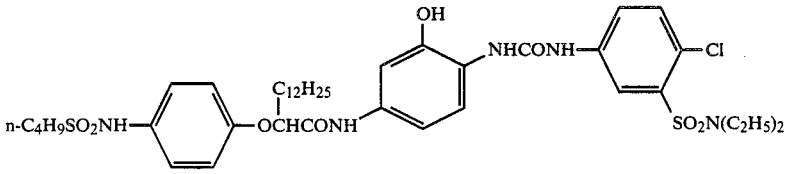

-continued
(36)
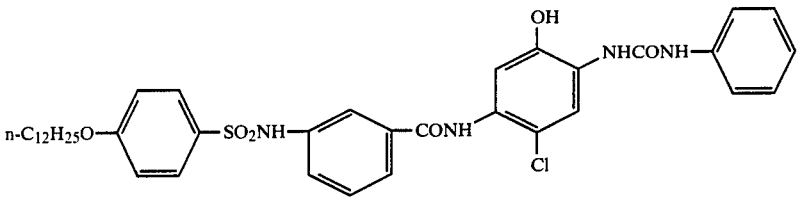
(37)
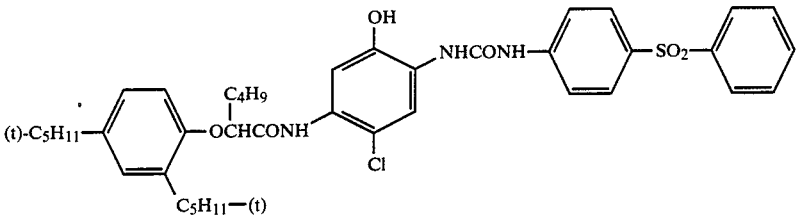
(38)
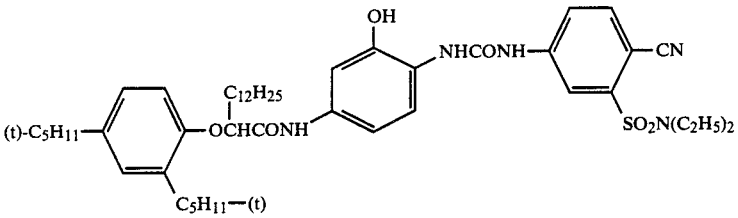
(39)
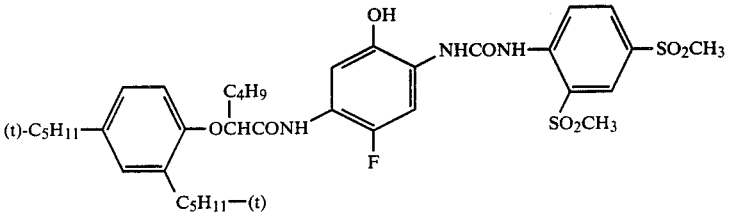
(40)
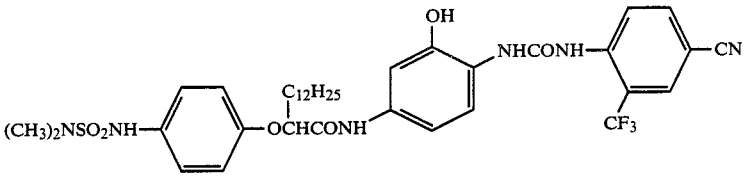
(41)
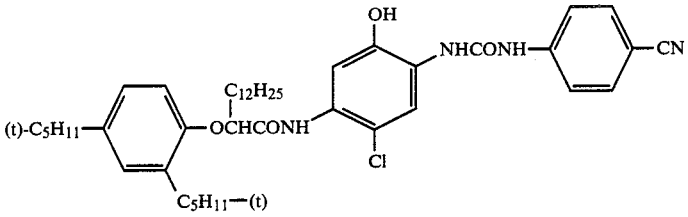
(42)
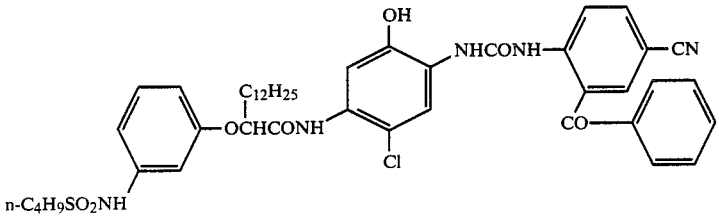

-continued
(43)
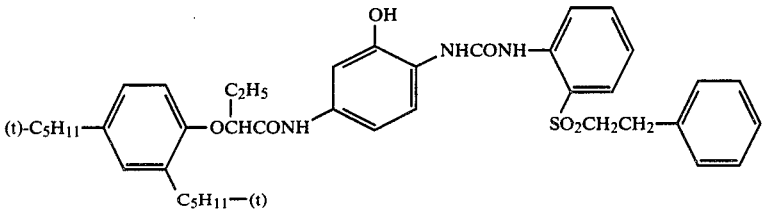
(44)
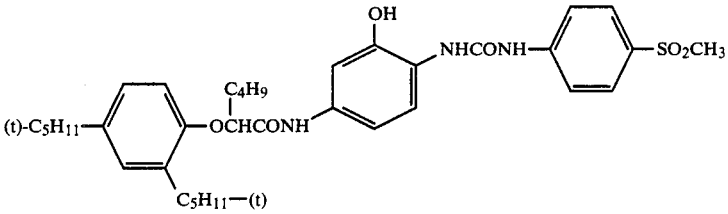
(45)
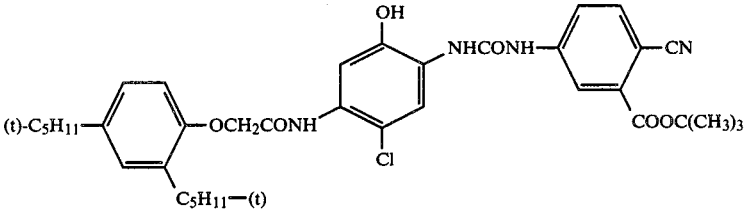
(46)
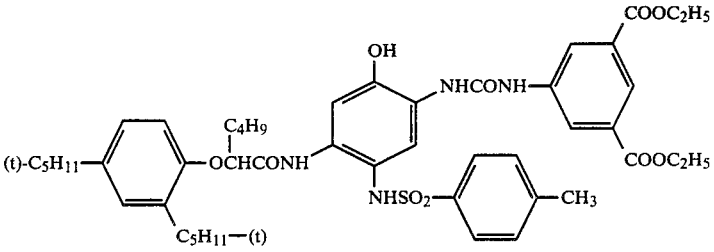
(47)
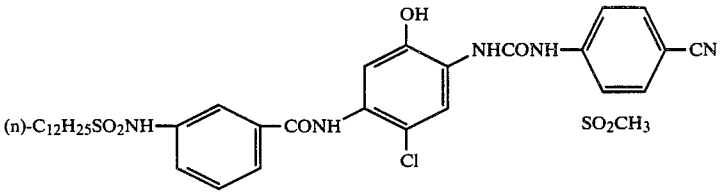
(48)
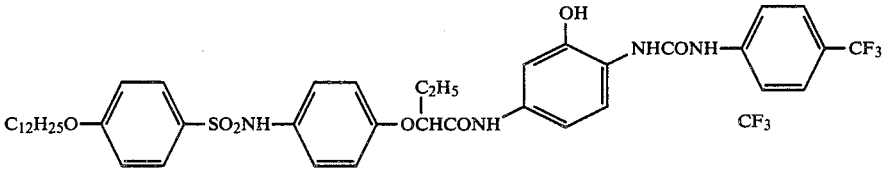
(49)
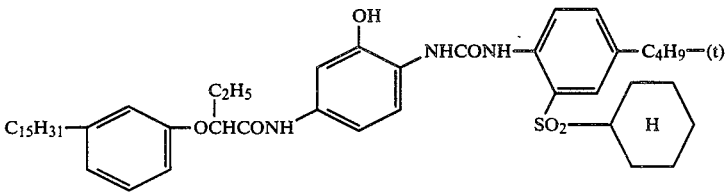

-continued
(50)
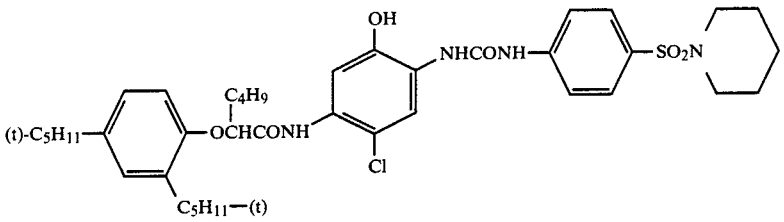
(51)
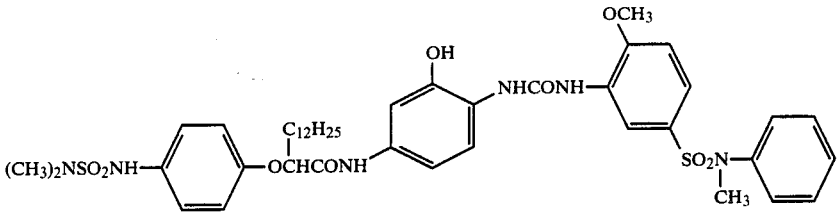
(52)
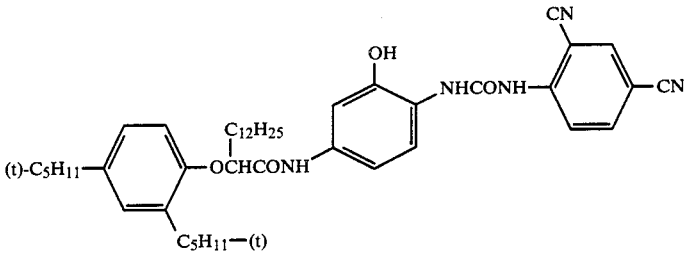
(53)
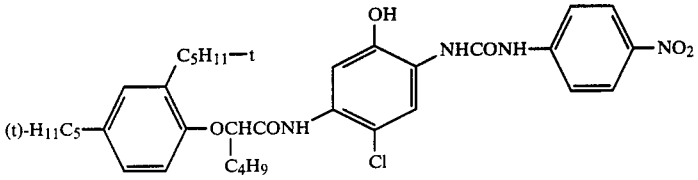
(54)
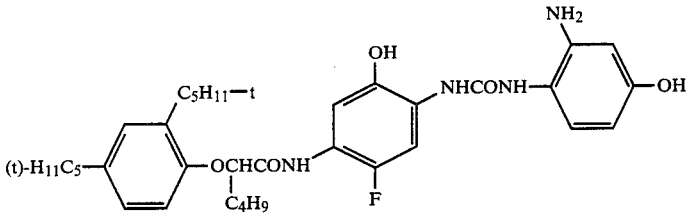
(55)
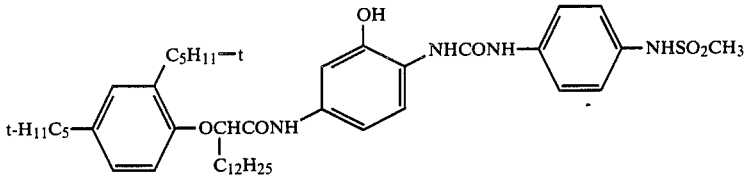
(56)
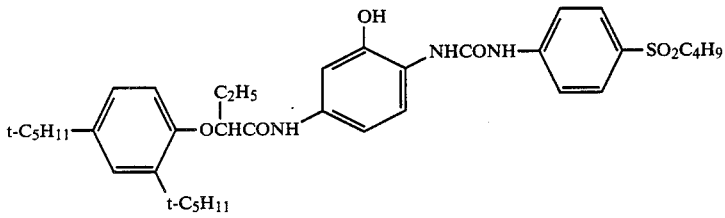
The monodispersive emulsion in the present invention is defined to be such that when the standard deviation S of its silver halide particle sizes as defined in the following formula is divided by the mean particle size $\bar{r}$, the quotient is not more than 0.20.
$$S = [(\Sigma[\bar{r} - ri]^2 ni)/\Sigma ni]^{\frac{1}{2}}$$

-continued $$\frac{S}{\bar{r}} \leqq 0.20$$

The above-mentioned "mean particle size," when the silver halide particle is in the globular form, means its diameter, or, when the particle is in the nonglobular form, means the mean value of the diameters of circles converted in equal sizes from its projected figures. When each individual particle size is ri and when the number of particles is ni, the $\bar{r}$ is as defined by the following formula:

$$\bar{r} = \frac{\Sigma ni\ ri}{\Sigma ni}$$

The emulsion can be a negative-type emulsion or a direct-positive-type emulsion. For these emulsions there may be used a surface latent image-type emulsion which forms a latent image principally on the surface of the silver halide particles thereof, an internal latent image-type emulsion which forms a latent image principally inside the silver halide particles thereof, or a mixture of both surface latent image-type emulsion and internal latent image-type emulsion.

The silver halide particles used for the silver halide color photographic light-sensitive material of the present invention may be in such the irregular crystal form as the globular or plate form, the so-called twin, or in such the regular crystal form as the cubic, octahedral or tetradecahedral form, but the latter is more preferred. There may also be used a mixture of both irregular and regular crystalline particles. And the particles may also be of the core-shell type.

The silver halide to be used for the color photographic light-sensitive material of the present invention is comprised substantially of silver iodobromide containing preferably less than 12 mole % of silver iodide. The "substantially" herein means that even when the silver halide contains partially silver iodobromide whose silver iodide content exceeds 12 mole % which is produced during the preparation of the silver halide, the average of the silver iodide content is less than 12 mole %. The preferred silver iodide content in the present invention is from 1 to 8 mole %.

The silver halide used in the silver halide color photographic light-sensitive material of the present invention may be produced by any one of the acidic method, neutral method and ammoniacal method, or may also be produced, for example, in the manner that seed particles are first prepared by the acidic method, and further grown up to a specified particle size by the ammoniacal method capable of growing silver halide particles fast. In the case of growing the silver halide particles, it is desirable to control the pH, pAg, etc., inside the reaction chamber, and pour thereinto simultaneously silver and halide ions to mix them in quantities suitable for the growth rate of the silver halide particles as described in, e.g., Japanese Patent O.P.I. Publication No.48521/1979.

The silver halide may be chemically sensitized by use of active gelatin; such sulfur sensitizers as allylthiocarbamide, thiourea, cystine, etc.; selenium sensitizers; such reduction sensitizers as, e.g., stannous salts, thiourea dioxide, polyamines, etc.; noble-metallic sensitizers including such gold sensitizers as potassium aurithiocyanate, potassium chloroaurate, 2-aurosulfobenzothiazonium chloride, etc., and such sensitizers as water-soluble salts of ruthenium, palladium, platinum, rhodium, iridium, etc., particularly, ammonium chloropalladate, potassium chloroplatinate, sodium chloropalladate, etc., (some of these compounds act as sensitizers or antifogants depending upon the quantity used); and the like. These sensitizers may be used singly or in arbitrary combination (e.g., the combined use of a gold sensitizer with a sulfur sensitizer, the combined use of a gold sensitizer with a selenium sensitizer, or the like).

Further, the silver halide can be optically sensitized to a desired wavelength region. For example, such cyanine dyes as zeromethine dyes, monomethine dyes, dimethine dyes, trimethine dyes, etc., or merocyanine dyes may be used singly or in combination (e.g., for supersensitization) to optically sensitize the silver halide.

The quantity of silver of the monodispersive silver halide particles contained in the silver halide emulsion layer containing the photographic cyan coupler of the present invention which constitutes the silver halide photographic light-sensitive material of the present invention is generally from 1.5 g/m$^2$ to 10.0 g/m$^2$, and preferably from 2.0 g/m$^2$ to 6.0 g/m$^2$.

The silver halide photographic light-sensitive material of the present invention is certainly allowed to be one that is coated not only with a silver halide emulsion layer containing the foregoing photographic cyan coupler of the present invention but also with a magenta coupler-containing silver halide emulsion layer and an yellow coupler-containing silver halide emulsion layer. In this instance, the total amount of the silver of all the light-sensitive silver halide emulsions contained in the silver halide photographic light-sensitive material is generally from 5.5 g/m$^2$ to 15.0 g/m$^2$, and preferably from 5.5 g/m$^2$ to 10.0 g/m$^2$. In addition, the silver halide particles contained in the above-mentioned magenta and yellow couplers-containing emulsion layers may be either monodispersive or non-monodispersive.

In the silver halide color photographic light-sensitive material of the present invention, for example, the silver halide emulsion layer containing the photographic cyan coupler of the present invention is a red-sensitive layer, but this light-sensitive layer may be comprised of a plurality of silver halide emulsion layers having the same color sensitivity but differing in the speed.

The combination of the cyan coupler with the monodispersive silver halide particles in the present invention should be contained in at least one of these plurality of silver halide emulsion layers.

The silver halide color photographic light-sensitive material of the present invention may contain dye-forming couplers other than that of the present invention; that is, compounds capable of forming dyes by the reaction thereof with the oxidized product of an aromatic amine (generally, primary amine) developing agent. Such couplers are desirable to be nondiffusible, having a hydrophobic radical called the ballasting radical, and are allowed to be either 4-equivalent or 2-equivalent to silver ions.

As the yellow coupler, those open-chain ketomethylene-type couplers may be used, of which the benzoylacetanilide-type and pivaloylacetanilide-type compounds are advantageously usable. Examples of those usable yellow coupers are as described in U.S. Pat. Nos. 2,875,057, 3,265,506, 3,408,194, 3,551,135, 3,582,322, 3,725,072 and 3,891,445; West German Pat. No. 1,547,868, West German OLS Pat. Nos. 2,219,917, 2,261,361 and 2,414,006; British Pat. No. 1,425,020;

Japanese Patent Examined Publication No. 10783/1976; Japanese Patent O.P.I. Publication Nos.26133/1972, 73147/1973, 102636/1976, 6341/1975, 123342/1975, 130442/1975, 21827/1976, 87650/1975, 82424/1977 and 115219/1977; and the like.

As the magenta color-forming coupler, pyrazolone-type compounds, indazolone-type compounds, cyanoacetyl compounds, and the like, may be used, of which pyrazolone-type compounds are advantageously usable. Examples of those usable magenta colorforming couplers are as described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908 and 3,891,445; West German Pat. No. 1,810,464, West German OLS Patent Nos. 2,408,665, 2,417,945, 2,418,959 and 2,424,467; Japanese Patent Examined Publication No. 6031/1965; Japanese Patent O.P.I. Publication Nos. 20826/1976, 58922/1977, 129538/1974, 74027/1974, 159336/1975, 42121/1977, 74028/1974, 60233/1975, 26541/1976, and 55122/1978; and the like.

Further, the cyan coupler of the present invention may be used in combination with other cyan couplers. For example, those combinedly usable cyan couplers include phenol-type compounds and naphthol-type compounds, examples of which compounds are as described in U.S. Pat. Nos. 2,369,929, 2,434,272, 2,474,297, 2,521,908, 2,895,826, 3,034,892, 2,311,476, 3,458,315, 3,476,563, 3,583,971, 3,591,383, 3,767,411 and 4,004,929; West German OLS Patent Nos. 2,414,830 and 2,454,329; and Japanese Patent O.P.I. Publication Nos. 59838/1973, 26034/1976, 5055/1973, 146828/1976, 69624/1977 and 90932/1977.

Not less than two of the above couplers are allowed to be contained in a same layer. A same compound may be contained in not less than two different layers. Any of these couplers is incorporated into an emulsion layer in a quantity of generally from $2\times10^{-3}$ mole to $5\times10^{-1}$ mole, and preferably from $1\times10^{-2}$ mole to $5\times10^{-1}$ mole per mole of the silver contained in the emulsion layer.

The incorporation of any of the above couplers may be carried out by any such known methods as described in U.S. Pat. No. 2,322,027. For example, the coupler is dissolved into a solvent, and the solution is then dispersed into a hydrophilic colloid, the said solvent including alkyl phthalates (such as dibutyl phthalate, dioctyl phthalate, etc.), phosphates (such as diphenyl phosphate, triphenyl phosphate, tricresyl phosphate, dioctyl phosphate), citrates (such as tributylacetyl citrate), benzoates (such as octyl benzoate), alkylamides (such as diethyl-laurylamide), fatty acid esters (such as dibutoxyethyl succinate, dioctyl azelate), and the like, and organic solvents with a boiling point of from about 30° C. to 150° C. including such lower alkyl acetates as, e.g., ethyl acetate, butyl acetate, etc., and ethyl propionate, secondary butyl alcohol, methyl-isobutyl ketone, $\beta$-ethoxyethyl acetate, methyl cellosolve acetate, and the like. The above high-boiling and low-boiling solvents may be mixed to be used.

There may also be used the dispersing method by use of those polymers as described in Japanese Patent Examined Publication No. 39853/1976 and Japanese Patent O.P.I. Publication No. 59943/1976. In the case of a coupler having an acid radical such as of carboxylic acid, sulfonic acid, etc., the coupler can be introduced in an alkaline aqueous solution into a hydrophilic colloid.

The silver halide color photographic light-sensitive material of the present invention may contain in the hydrophilic colloidal layer thereof an ultraviolet-absorbing agent, which includes, for example, aryl radical-substituted benzotriazole compounds (as described in, e.g., U.S. Pat. No.3,533,794), 4-thiazolidone compounds (as described in, e.g., U.S. Pat. Nos. 3,314,794 and 3,352,681), benzophenone compounds (as described in, e.g., Japanese Patent O.P.I. Publication No. 2784/1971), cinnamic acid ester compounds (as described in, e.g., U.S. Pat. Nos. 3,705,805 and 3,707,375), butadiene compounds (as described in, e.g., U.S. Pat. No. 4,045,229), benzoxazole compounds (as described in, e.g., U.S. Pat. No. 3,700,455), and further those as described in U.S. Pat. No. 3,499,762 and Japanese Patent O.P.I. Publication No. 48535/1979. Those ultraviolet-absorbent couplers (such as, e.g., $\alpha$-naphthol-type cyan dye-forming coupler) or ultraviolet-absorbent polymers may also be used. These ultraviolet absorbing agents may be mordanted into a specific layer.

In the silver halide color photographic light-sensitive material to which is applied the present invention, those hydrophilic colloids advantageously usable for the preparation of the silver halide emulsion and those hydrophilic colloids usable for the nonlight-sensitive hydrophilic colloidal layer include gelatin and gelatin derivatives as phenylcarbamylated gelatin, amylated gelatin, phthalated gelatin, etc.; colloidal albumin; agar-agar; gum arabic; such cellulose derivatives as hydrolyzed cellulose acetate, carboxymethyl cellulose, hydroxyethyl cellulose, methyl cellulose, etc.; acrylamide, imidated acrylamide; casein; such vinyl alcohol polymers containing urethanecarboxylic acid radical or cyanoacetyl radical as, e.g., vinyl alcohol-vinylcyanoacetate copolymer; polyvinyl alcohol; polyvinyl pyrolidone; hydrolyzed polyvinyl acetate; polymers obtained by the polymerization reaction of protein or saturated, acylated protein with vinyl radical-having monomers; and the like.

To the above silver halide emulsion, in order to prevent possible lowering of its speed or possible occurrence of fog during the manufacture, storage or processing thereof, may be added various compounds including such heterocyclic compounds as 1-phenyl-5-mercaptotetrazole, 3-methylbenzothiazole, 4-hydroxy-6-methyl-1,3,3a,7-tetrazaindene, etc.; mercapto compounds; metallic salts; and the like.

The hardening processing of the emulsion may be carried out in usual manner. Those usable hardening agents include, for example, aldehyde-type compounds such as formaldehyde, glyoxal, glutaraldehyde, etc., or derivative compounds thereof such as acetal- or sodium hydrogensulfite-addition products; methanesulfonic acid ester-type compounds; epoxy-type compounds; aziridine-type compounds; active vinyl-type compounds; carbonimide-type compounds; iso-oxazole-type compounds; N-methylol-type compounds; isocyanate-type compounds; such inorganic hardening agents as chrome alum, zirconium sulfate, etc.; and the like.

To the above silver halide emulsion may be added surfactants singly or in combination in the form of a mixture. As the surfactant for use as coating aids, emulsifiers, agents for improving the permeation into processing liquids, etc., deforming agents, antistatic agents, antiadherence agents, materials for controlling photographic or physical characteristics, and the like, there may be used various surface active atents such as nonionic surface active agents including such a natural substance as saponin, alkyleneoxide-type, glycerol-type, glycidol-type and the like compounds; cationic surface active agents such as higher alkylamines, pyridine and other heterocyclic compounds, quaternary nitrogen-onium salts, phosphoniums or sulfoniums, etc.; anionic surface active agents such as those compounds containing such acid radicals as of carboxylic acid, sulfonic acid, phosphoric acid, sulfuric acid ester radicals, phosphoric acid radicals, etc.; amphoteric surface active agents such as amino acids, aminosulfonic acids, etc.; and the like.

The silver halide color photographic light-sensitive material of the present invention may contain in the component layers thereof (e.g., a protective layer, interlayers, emulsion layers, a backing layer, etc.) an ultraviolet absorbing agent, which includes benzotriazoles, triazines, benzophenone-type compounds, acrylonitrile-type compounds, and the like. Particularly those preferred are Tinuvin-Ps, −320, −326, −327, −328, etc., produced by Ciba Geigy (AG), which may be used singly or in combination.

Further, for the purpose of increasing the stability of resulting color photographs, p-substituted phenols may be contained in the emulsion layers and/or the nonlight-sensitive hydrophilic colloidal layers adjacent thereto of the silver halide color photographic light-sensitive material of the present invention.

Those particularly preferred p-substituted phenols include alkyl-substituted hydroquinones, bishydroquinones, polymer-type hydroquinones, p-alkoxyphenols, phenolic compounds, and the like. Further, those alkoxy or amyloxy derivatives of 6-chromanol or 6,6'-dihydroxy-2,2'-spirochroman may also be used.

The silver halide color photographic light-sensitive material of the present invention is produced by coating its component layers on a good flatness-having and less-dimentionallychangeable support. Those materials usable as the support include films such as of cellulose acetate, cellulose nitrate, polyvinyl acetate, polypropylene, polyethylene terephthalate, polyamide, polycarbonate, polystyrene, etc., or polyethylenelaminated paper, polypropylene synthetic paper, baryta paper, and the like. These support materials are to be selected arbitrarily according to uses of the silver halide color photographic material.

The support, in order to strengthen the adherence thereof to the silver halide emulsion layer, is generally subjected to subbing treatment. Typical materials usable for the subbing treatment include copolymers of vinyl chloride or vinylidene chloride, copolymers of esters of vinyl alcohol, copolymers containing unsaturated carboxylic acids, copolymers of such dienes as butadiene, copolymers of acetals, copolymers of such unsaturated carboxylic anhydride as maleic anhydride, and the like, with particularly such vinyl alcohol esters as vinyl acetate or with styrene, or ring-open compounds thereof by water, alkalis, alcohols or amines; and further cellulose derivatives such as nitrocellulose, diacetyl cellulose, etc., epoxy radical-containing compounds, gelatin or modified gelatin, polyolefin copolymers, and the like.

Further, gelatin or polyols, monohydric or polyhydric phenols and halogen-substituted compounds thereof, cross-linking agents (hardeners), metallic oxides, and the like, may also be used in combination with these subbing materials to carry out subbing treatments.

In the actual practice of subjecting the support to the subbing treatment, the above subbing materials may be used singly or in combination. The subbing treatment may be effected by coating a single subbing layer or superposed subbing layers, and may certainly be made by coating further additional layers by using together with different subbing materials; for example, such superposedly coating methods as the coating of an additional gelatin layer over a vinylidene chloride copolymer layer, and the coating in order of a vinylidene chloride copolymer layer, a layer of a mixture of gelatin with the vinylidene chloride copolymer, and a gelatin layer. Thus, in accordance with purposes arbitrary materials may be used in combination for coating subbing layers.

Aside from the subbing treatments by use of the above subbing materials, such surface treatments as the corona-discharge treatment, glow-discharge treatment and other electron-impact treatments; flame treatment, ultraviolet-radiation treatment, oxidation treatment, saponification treatment, surface-roughing treatment, and the like, may be applied to the support to improve the adherence thereof to the emulsion layer. These treatments may be used alone or in combination, and further the aforementioned subbing materials may be combinedly used to thereby carry out more sufficient subbing treatments.

The silver halide color photographic light-sensitive material of the present invention include all kinds of silver halide color photographic light-sensitive material such as color negative film, color positive film, color reversal film, color photographic paper, and the like.

As the bleaching agent used in the bleach-fix bath in the present invention, various compounds may be used. For example, a metallic complex salt of an organic acid oxidizes the metallic silver produced by development back into a silver halide and at the same time causes the not-color-formed portion of a color-forming coupler to form its color, and its structure is the coordinate of an organic acid such as an aminopolycarboxylic acid, oxalic acid, citric acid, etc., with such metallic ions as of iron, cobalt, copper, etc. The most preferred organic acid for use in the formation of such a metallic complex salt of an organic acid includes:

- ethylenediaminetetraacetic acid,
- diethylenetriaminepentaacetic acid,
- ethylenediamine-N-(β-oxyethyl)-N,N',N'-triacetic acid,
- propylenediaminetetraacetic acid,
- nitrilotriacetic acid,
- cyclohexanediaminetetraacetic acid,
- iminodiacetic acid,
- dihydroxyethylglycine,
- ethyl-ether-diaminetetraacetic acid,
- glycol-ether-aminetetraacetic acid,
- ethylenediaminetetrapropionic acid,
- phenylenediaminetetraacetic acid,
- disodium ethylenediaminetetraacetate,
- tetra(trimethylammonium) ethylenediaminetetraacetate,
- tetrasodium ethylenediaminetetraacetate,
- pentasodium diethylenetriaminepentaacetate,
- sodium ethylenediamine-N-(β-oxyethyl)-N,N',N'-triacetate, and
- sodium propylenediaminetetraacetate.

The bleaching agent to be contained in the bleach-fix bath of the present invention may be at least one of the above bleaching agents; not less than two of them certainly may be used. The using quantity depends on the kind of the agent used, but is approximately not less than 0.01 mole, and more preferably not less than 0.05 mole per liter of the bleach-fix liquid.

As the bleach-fix bath in the present invention, there may be used a composition containing such silver halide fixing agents as a thiosulate, thiocyanate, thiourea, etc., along with the above-described metallic complex salt (e.g., iron complex salt) of an organic acid. Further, there may also be used a bleach-fix bath of a composition comprising a small amount of such a halide compound as potassium bromide aside from the above bleaching agent and silver halide fixing agent; a bleach-fix bath of a composition comprising, on the contrary, a large amount of such a halide compound as potassium bromide; and a special bleach-fix bath of a composition comprising a combination of the bleaching agent with a large amount of such a halide compound as potassium bromide. As the above halide compound, in addition to the potassium bromide, there may also be used hydrochloric acid, hydrobromic acid, lithium bromide, sodium bromide, ammonium bromide, potassium iodide, ammonium iodide, and the like.

The silver halide fixing agent to be incorporated into the bleach-fix bath includes those compounds for use in the usual fixing process, which react with a silver halide to form a water-soluble complex salt, the said compounds including as typical ones, e.g., such thiosulfates as potassium thiosulfate, sodium thiosulfate, ammonium thiosulfate, etc.; such thiocyanates as potassium thiocyanate, sodium thiocyanate, ammonium thiocyanate, etc.; thiourea; bromides or iodides containing a high concentration of thioether; and the like.

The fixing agent content of the bleach-fix bath of the present invention is generally from 5.0 g to 200 g, and preferably from 50 g to 100 g per liter of the bleach-fix liquid.

Into the bleach-fix bath there may be incorporated alone or in combination such pH buffers including boric acid, borax, sodium hydroxide, potassium hydroxide, sodium carbonate, potassium carbonate, sodium hydrogencarbonate, potassium hydrogencarbonate, aceitc acid, sodium acetate, ammonium hydroxide, and the like. Further, various defoaming agents, surface active agents may also be incorporated. Furthermore, such preservatives as the hydrogensulfite-addition products of hydroxylamine, hydrazine, and aldehyde compounds; such organic chelating agents as aminopolycarboxylic acids; a kind of stabilizing agent such as nitroalcohol nitrate, etc.; such organic solvents as methanol, dimethylformamide, diemthylsulfoxide, etc.; and the like, may also be arbitrarily incorporated.

The bleach-fix bath of the present invention is used at a pH of not less than 5.0, but generally a pH of from 5.5 to 9.0, and preferably from 6.0 to 8.5. More particularly, the most preferred pH is from 7.0 to 8.5. The bleach-fix bath is used at a temperature of not more than 80° C., and preferably not more than 55° C. to restrain the evaporation of the liquid.

The bleach-fix processing period of time, although different according to the processing temperature used, is generally from 30 seconds to 10 minutes, and preferably from 1 minute to 5 minutes.

The color developing agent used in the present invention is an aromatic primary amine compound, and particularly preferably a p-phenylenediamine-type developing agent, which includes, e.g., 4-amino-N,N-diethylaniline, 3-methyl-4-amino-N,N-diethylaniline, 4-amino-N-ethyl-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β3-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]-ethyl-3-methyl-4-aminoaniline, N-ethyl-N-β- β-methoxyethoxy)ethyl-3-methyl-4-aminoaniline, and those salts of these compounds, such as sulfates, hydrochlorides, sulfites, p-toluenesulfonates, and the like.

Photographic additives to be used in the color developer liquid containing any one of the above color developing agents include alkali agents (e.g., alkali metals; hydroxide, carbonate and phosphate of ammonium); pH control agents or buffers (e.g., such weak acids or weak bases as acetic acid, boric acid, and the salts thereof); development accelerators (e.g., pyridinium compounds, cationic compounds, potassium nitrate and sodium nitrate, polyethylene glycol condensates and the derivatives thereof, nonionic compounds such as polythioethers, sulfite ester-containing polymer compounds, pyridine, ethanolamines, organic amines, benzyl alcohol, hydrazines, etc.); antifogants (e.g., alkali bromide, alkali iodide, nitrobenzimidazoles, mercaptobenzimidazoles, 5-methylbenzotriazole, 1-phenyl-5-mercaptotetrazole); compounds for rapid processing use; nitrobenzoic acid; benzothiazolium derivatives; phenazine-N-oxides; antistain or antisludge agents; interimage effect accelerators; preservatives (e.g., sulfites, hydrogensulfites, hydroxylamine hydrochlorides, formsulfites, alkanolamine sulfite-addition products, etc.); and the like.

The color developing process and the bleach-fix process may not necessarily be carried out consecutively. Before or after each of the processes, other processes such as hardening, stop, neutralizing, washing, stabilizing, etc., can be inserted.

EFFECT OF THE INVENTION

Thus, by the application of the present invention there can be effected an excellent method for processing silver halide photographic light-sensitive materials, which enables to obtain satisfactorily desilvered photographic images without bringing about any cyan dye loss and any cyan stain.

EXAMPLES

The present invention will be illustrated in detail by the following examples, but the present invention is not limitted thereto.

First, methods for the preparation of emulsions for use ing the following examples are described below:

Preparation of a polydispersive emulsion

An ammoniacal silver nitrate and an aqueous alkali halide solution were spontaneously let fall into a reaction pot kept at a temperature of 60° C., in advance containing an aqueous gelatin solution and an excess of a halide, and to the resulting mixture were then added an aqueous Demol N (produced by Kawo Atlas, Co., Ltd.) solution and an aqueous magnesium sulfate solution to thereby produce a precipitate, which is then desalted and to which was then added gelatin, whereby an emulsion of pAg 7.8 and pH 6.0 was obtained. Further, to the emulsion were added sodium thiosulfate, chloroauric acid and ammonium thiocyanate to effect a chemical ripening at 52° C. for a period of 70 minutes, then added 4-hydroxy-6-methyl-1,3,3a,7-tetrazaindene and 6-nitrobenzimidazole, and then added gelatin to thereby obtain a polydispersive silver iodobromide emulsion. In this process, the alkali halide composition was changed to thereby change the mole percentage of the silver iodide, and the spending periods of time for adding the ammoniacal silver nitrate and alkali halide solution were changed to thereby change the mean particle size and the particle size distribution.

Preparation of a monodispersive emulsion

Into a reaction pot in advance containing potassium iodide and an aqueous gelatin solution, with keeping the pAg inside the reaction pot on a given level, were added an aqueous ammoniacal silver nitrate solution and an aqueous potassium bromide solution in proportion to the increasing surface area of the growing particles. To this were then added an aqueous Demol N (produced by Kawo Atlas Co., Ltd.) solution and an aqueous magnesium sulfate solution. The resulting precipitate was desalted, to which was then added gelatin, whereby an emulsion of pAg 7.8 and pH 6.0 was obtained. Further, to the emulsion were added sodium thiosulfate, chloroauric acid, and ammonium thiocyanate to effect ripening of the emulsion, and then added 4-hydroxy-6-methyl-1,3,3a,7-tetrazaindene and 6-nitrobenzimidazole, and further gelatin, whereby a monodispersive silver iodobromide emulsion was obtained.

In this process, the proportion of the potassium iodide to the potassium bromide was changed to thereby change the mole percentage of the silver iodide, and the value of the pAg to be fixed inside the reaction pot was changed to thereby change the crystal habit. Furthermore, adding quantities of the ammoniacal silver nitrate and potassium halide were changed to thereby change the particle size.

EXAMPLE 1

Over a transparent cellulose triacetate film support were coated in order the following first to thirteenth layers to thereby prepare multilayered color negative light-sensitive material samples (Samples 1 to 10):

First layer: Antihalation layer

A black colloidal silver-containing aqueous gelatin solution was coated so that the coating quantity of the silver is 0.3 g/m$^2$.

Second layer: Interlayer

An aqueous gelatin solution was coated so that the dry thickness is 1.0$\mu$.

Third layer: Red-sensitive low-speed silver halide emulsion layer

Each of the silver iodobromide emulsions given in Table 1 was chemically sensitized by use of gold and sulfur sensitizers, and to the emulsion were added red-sensitive sensitizing dyes anhydrous 9-ethyl-3,3'-di-(3-sulfopropyl)-4,5,4',5'-dibenzothiacarbocyaninehydroxide, anhydrous 5,5'-dichloro-9-ethyl-3,3'-di-(3-sulfobutyl)thiacarbocyaninehydroxide, and anhydous 2-[2-{(5-chloro-3-ethyl-2(3H)-bezothiazolidene)methyl}-1-butenyl-5-chloro-3-(4-sulfobutyl)benzoxazolium, and then further added 1.0 g of 4-hydroxy-6-methyl-1,3,3a,7-tetrazaindene and 20.0 mg of 1-phenyl-5-mercaptotetrazole, whereby a red-sensitive low-speed emulsion. Further, 59 g per mole of silver halide of the cyan coupler as given in Table 1 and 0.5 g of dodecyl gallate were dissolved by heating into a mixture of 65 g of trecresyl phosphate with 136 ml of ethyl acetate, and the resulting solution was added to 550 ml of a 7.5% aqueous gelatin solution containing 5 g of sodium triisopropylnaphthalenesulfonate, and then emulsifiedly dispersed by means of a colloid mill. The resulting dispersed liquid was added to the foregoing emulsion to thereby prepare a red-sensitive low-speed emulsion, which was then coated so that the coating quantity of silver is 2.0 g/m$^2$ (containing 160 g of gelatin per mole of silver halide).

Fourth layer: Red-sensitive high-speed silver halide emulsion layer

Each of the silver iodobromide emulsions as given in Table 1 was chemically sensitized by use of gold and sulfur sensitizers, and to the emulsion were added red-sensitizing dyes anhydrous 9-ethyl-3,3'-di-(3-sulfopropyl)-4,5,4', 5'-dibenzothiacarbocyaninehydroxide, anhydrous 5,5'-dichloro-9-ethyl-3,3'-di-(3-sulfobutyl)-thiacarbocyaninehydroxide, and anhydrous 2-[2-{(5-chloro-3-ethyl-2(3H)-benzothiazolidene)methyl}-1-butenyl-5-chloro-3-(4-sulfobutyl)benzoxazolium, and further added 1.0 g of 4-hydroxy-6-methyl-1,3,3a,7-tetrazaindene and 10.0 mg of 1-phenyl-5-mercaptotetrazole to thereby prepare a red-sensitive high-speed silver halide emulsion. Further, 17 g per mole of silver halide of the cyan coupler as given in Table 1 and 0.5 g of dodecyl gallate were dissolved by heating into a mixture of 20 g of tricresyl phosphate with 60 ml of ethyl acetate, and the resulting solution was added to 30 ml of a 7.5% aqueous gelatin solution containing 1.5 g of sodium triisopropylnaphthalenesulfonate, and then emulsifiedly dispersed by means of a colloid mill. The resulting dispersed liquid was added to the above-prepared emulsion to thereby prepare a red-sensitive high-speed emulsion, which was then coated so that the coating quantity of silver is 2.0 g/m$^2$ (containing 160 g of gelatin per mole of silver halide).

Fifth layer: Interlayer

The same as the second layer.

Sixth layer: Green-sensitive low-speed silver halide emulsion layer

A silver iodobromide emulsion whose silver halide mean particle size is 0.6$\mu$ and which contains 4 mole % of silver iodide and another silver iodobromide emulsion whose silver halide mean particle size is 0.3$\mu$ and which contains 7 mole % of silver iodide were each separately chemically sensitized by the addition thereto of gold and sulfur sensitizers, and to each of the emulsions were added green-sensitizing dyes anhydrous 5,5'-dichloro-9-ethyl-3,3'-di-(3-sulfobutyl)oxacarbocyaninehydroxide, anhydrous 5,5'-diphenyl-9-ethyl-3,3'-di(3-sulfobutyl)oxacarbocyaninehydroxide, and anhydrous 9-ethyl3,3'-di-(3-sulfopropyl)-5,6,5',6'-benzoxacarbocyaninehydroxide, and further added 1.0 g of 4-hydroxy-6-methyl-1,3,3a,7-tetrazaindene and 20,0 mg of 1-phenyl-5-mercaptotetrazole, thus preparing in usual manner two emulsions. The thus prepared two different emulsions were mixed in the proportion of 1 to 1, whereby a green-sensitive silver halide emulsion. Further, 100 g per mole of silver halide of a magenta coupler 1-(2,4,6-trichlorophenyl)-3-{3-(2,4-di-t-amylphenoxy)acetamido}-5-pyrazolone, 2.5g of a colored magenta coupler 1-(2,4, 6-trichlorophenyl)-4-(1-naphthylazo)-3-(2-chloro-5-octadecenylsuccinimidoanilino)-5-pyrazolone, 0.5 g of dodecyl gallate, and 1.8 g of a DIR compound 2-(1-phenyl-5-tetrazolylthio)-4-octadecylsuccinimido-1-indanone were dissolved by heating into a mixture of 120 g of tricresyl phosphate with 240 ml of ethyl acetate. The resulting solution was then added to an aqueous gelatin solution containing sodium triisopropylnaphthalenesulfonate, and emulsifiedly dispersed by means of a molloid mill. The thus produced dispersed liquid was then added to the foregoing emulsion to thereby prepare a green-sensitive low-speed emulsion, which was then coated so that the coating quantity of silver is 1.5 g/m$^2$ (containing 160 g of gelatin per mole of silver halide).

Seventh layer: Green-sensitive high-speed silver halide emulsion layer

A silver iodobromide emulsion (mean particle size 1.2$\mu$, containing 7 mole % of silver iodide) was chemically sensitized by use of gold and sulfur sensitizers, and to the emulsion were added green-sensitizing dyes anhydrous 5,5'-dichloro-9-ethyl-3,3-di-(3-sulfobutyl)oxacarbocyaninehydroxide, anhydrous 5,5'-diphenyl-9-ethyl-3,3'-di-(3-sulfobutyl)oxacarbocyaninehydroxide, and anhydrous-9-ethyl-3,3'-di-(3-sulfopropyl)5,6,5'6'-dibenzoxacarbocyaninehydroxide, and further added 1.0 g of 4-hydroxy-6-methyl-1,3,3a,7-tetrazaindene and 10.0 mg of 1-phenyl-5-mercaptotetrazole to thereby prepare a green-sensitive high-speed silver halide emulsion. Further, 80 g per mole of silver halide of a magenta coupler 1-(2,4,6-trichlorophenyl)-3-{-(2,4-di-t-amylphenoxy)acetamido,}-5-pyrazolone, 2.5 g of a colored magenta coupler 1-(2,4,6-trichlorophenyl)-4-(1-naphthylazo)-3-(2-chloro-5-octadecenylsuccinimidoanilino)-5-pyrazolone, 1.5 g of 2,5-di-t-octylhydroquinone, and 1.0 g of a DIR compound 2-(1-phenyl-5-tetrazolylthio)-4-octadecylsuccinimide-1-indanone were dissolved by heating into a mixture of 120 g of tricresylphosphate with 240 ml of ethyl acetate, and the resulting solution was added to an aqueous gelatin solution containing sodium triisopropylnaphthalenesulfonate, and emulsifiedly dispersed by means of a colloid mill. The thus produced dispersed liquid was then added to the foregoing emulsion to thereby prepare a green-sensitive high-speed emulsion, which was then coated so that the coating quantity of silver is 1.8 g/m$^2$ (containing 160 g of gelatin per mole of silver halide).

Eighth layer: Interlayer

The same as the second layer.

Ninth layer: Yellow filter layer

To an yellow colloidal silver-dispersed aqueous gelatin solution was added a dispersed liquid prepared by dispersing into an aqueous gelatin solution containing 0.3 g of sodium triisopropylnaphthalenesulfonate a solution prepared by dissolving 3 g of 2,5-di-t-octylhydroquinone and 1.5 g of di-2-ethylhexylphthalate into 10 ml of ethyl acetate, and the resulting mixture liquid was coated so that the coating quantity of gelatin is 0.9 g/m$^2$ and that of the 2,5-di-t-octylhydroquinone 2. is 0.10 g/m Tenth layer: Blue-sensitive low-speed silver halide emulsion layer A silver iodobromide emulsion (mean particle size 0.6$\mu$, containing 6 mole % of silver iodide) was chemically sensitized by use of gold and sulfur sensitizers. To this emulsion were further added a sensitizing dye anhydrous 5,5'-dimethoxy-3,3'-di-(3-sulfopropyl)-thiacyaninehydroxide, and then 1.0 g of 4- hydroxy-6-methyl-1,3,3a,7-tetrazaindene and 20.0 mg of 1-phenyl-5-mercaptotetrazole, thereby preparing in usual manner a blue-sensitive low-speed silver halide emulsion. Further, 120 g per mole of silver halide of $\alpha$-pivaloyl-$\alpha$-(1-benzyl-2-phenyl-3,5-dioxo-1,2,4-triazolidine-4-yl)-2'-chloro-5'- -[-$\alpha$-(dodecyloxycarbonyl)ethyoxycrbonyl acetanilide and 50 g of $\alpha$- {3-[-(2,4-di-t-amylphenoxy)-butylamido)benzoyl-2 -methoxyacetanilide were dissolved by heating into a mixture of 120 g of dibutylphthalate with 300 ml of ethyl acetate, and the resulting solution was added to an aqueous gelatin solution containing sodium triisopropylnaphthalenesulfonate, and then emulsifiedly dispersed by means of a colloid mill. The thus produced dispersed liquid was added to the above-prepared emulsion to thereby prepare a blue-sensitive low-speed silver halide emulsion, which was coated so that the coating quantity of silver is 0.7 g/m$^2$ (containing 160 g of gelatin per mole of silver halide).

Eleventh layer: Blue-sensitive high-speed silver halide emulsion layer A silver iodobromide emulsion (mean particle size 1.2$\mu$, containing 7 mole % of silver iodide) was chemically sensitized by use of gold and sulfur sensitizers, and to the emulsion were added a sensitizing dye anhydrous 5,5'-dimethoxy-3,3'-di-(3-sulfopropyl)thiacyaninehydroxide, and further 1.0 g of 4-hydroxy-6-methyl-1,3,3a,7-tetrazaindene and 10.0 mg of 1-phenyl-5-mercaptotetrazole, thereby preparing in usual manner a blue-sensitive high-speed silver halide emulsion. Further, 80 g per mole of silver halide of an yellow coupler $\alpha$-pivaloyl-$\alpha$(1-1-2-phenyl-3,5-dioxo-1,2,4-triazolidine-4-yl)-2'-chloro-5'-[$\alpha$-(dodecyloxycarbonyl)ethoxycarbonyl-]acetanilide was dissolved by heating into a mixture of 80 g of dibutyl phthalate with 240 ml of ethyl acetate, and the solution was added to an aqueous gelatin solution containing sodium triisopropylnaphthalenesulfonate, and the emulsifiedly dispersed by means of a colloid mill. The resulting dispersed liquid was added to the above prepared emulsion to thereby obtain a blue-sensitive high-speed silver halide emulsion, which was coated so that the coating quantity of silver is 0.9 g/m$^2$ (containing 240 g of gelatin per mole of silver halide).

Twelfth layer: Interlayer

Two grams of di-2-ethylhexyl phthalate, 2 g of 2-[3-cyano3-(n-dodecylaminocarbonyl)anilidene]-1-ethylpyrolidine, and 2 ml of ethyl acetate were mixed to be added to and dispersed into an aqueous gelatin solution containing 0.6 g of sodium triisopropylnaphthalenesulfonate. The thus produced dispersed liquid was coated so that the coating quantity of gelatin is 1.0 g/m$^2$.

Thirteenth layer: Protective layer

An aqueous gelatin solution containing per 100 ml 4 g of gelatin and 0.2 g of 1,2-bisvinylsulfonylethane was coated so that the coating weight is 1.3 g/m$^2$.

The thus obtained samples each was exposed through an optical wedge to light, and then developed in the following two different processes. The results obtained with respect to the respective samples are as given in Table 1.

| Development Process Steps (at 38° C.) | Processing period |
|---|---|
| Color developing | 3 min. & 15 sec. |
| Bleach-fix | 3 min. & 15 sec. |
| Washing | 3 min. & 15 sec. |
| Stabilizing | 1 min. & 30 sec. |

The processing bath compositions used in the respective process steps are as follows:

Color developer composition

| | |
|---|---|
| 4-amino-3-methyl-N—ethyl-N—(β-hydroxyethyl)-aniline sulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Add water to make 1 liter. | |
| Use potassium hydroxide to adjust the pH to 10.0. | |

Bleach-fix bath composition

| | |
|---|---|
| Diammonium ethylenediaminetetraacetate | 7.5 g |
| Iron(III)-ammonium ethylenediaminetetraacetate | 120.0 g |
| Sodium sulfite | 3.0 g |
| Ammonium thiosulfate | 90.0 g |
| Add water to make 1 liter. | |

Stabilizer bath composition:

| | |
|---|---|
| Formalin (37% aqueous solution) | 5.0 ml |
| Koniducks (produced by Konishiroku Photo Industry Co., Ltd.) | 7.5 ml |
| Add water to make 1 liter | |

| Development Process Steps (at 38° C.) | Processing Period |
|---|---|
| Color developing | 3 min. & 15 sec. |
| Bleaching | 30 min. |
| Washing | 3 min. & 15 sec. |
| Fixing | 30 min. |
| Washing | 3 min. & 15 sec. |
| Stabilizing | 1 min. & 30 sec. |

The processing bath compositions used in the respective Process steps are as follows:

Color developer composition:

| | |
|---|---|
| 4-amino-3-methyl-N—ethyl-N—(β-hydroxyethyl)-aniline sulfate | 4.75 g |

-continued

| | |
|---|---|
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Add water to make 1 liter. | |
| Use potassium hydroxide to adjust the pH to 10.0. | |

Bleaching bath composition:

| | |
|---|---|
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Add water to make 1 liter. | |
| Use aqueous ammonia to adjust the pH to 6.0. | |

Fixer composition:

| | |
|---|---|
| Ammonium thiosulfate (50% aqueous solution) | 162.0 ml |
| Anhydrous sodium sulfite | 12.4 g |
| Add water to make 1 liter. | |
| Use acetic acid to adjust the pH to 6.5. | |

Stabilizer composition:

| | |
|---|---|
| Formalin (37% aqueous solution) | 5.0 ml |
| Koniducks (produced by Konishiroku Photo Industry Co., Ltd.) | 7.5 ml |
| Water to make 1 liter. | |

Comparative Couplers:

C-1

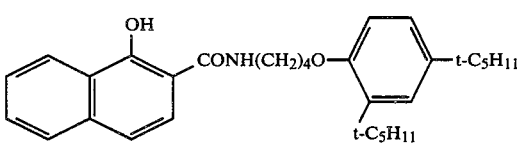

C-2

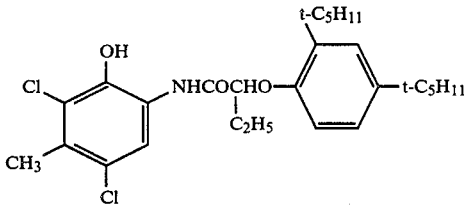

TABLE 1

| Sample No. | Cyan coupler | 3rd layer | r̄ | s/r̄ | 4th layer | r̄ | s/r̄ |
|---|---|---|---|---|---|---|---|
| 1 | Comparative cyan coupler C-1 | Polydispersive | 0.45<br>0.20 | 45<br>40 | Polydispersive | 1.00 | 50 |
| 2 | Comparative cyan coupler C-1 | Monodispersive | 0.45<br>0.20 | 0.15<br>0.16 | Monodispersive | 1.00 | 50 |
| 3 | Comparative cyan coupler C-2 | Polydispersive | 0.45<br>0.20 | 45<br>40 | Polydispersive | 1.00 | 50 |
| 4 | Comparative cyan coupler C-2 | Monodispersive | 0.45<br>0.20 | 0.15<br>0.16 | Monodispersive | 1.00 | 0.18 |
| 5 | Exemplified compound (11) | Polydispersive | 0.45<br>0.20 | 45<br>40 | Polydispersive | 1.00 | 50 |
| 6 | Exemplified | Monodispersive | 0.45 | 0.15 | Monodispersive | 1.00 | 0.18 |

TABLE 1-continued

| | | | | | | | |
|---|---|---|---|---|---|---|---|
| | compound (11) | | 0.20 | 0.16 | | | |
| 7 | Exemplified compound (22) | Polydispersive | 0.45<br>0.20 | 45<br>40 | Polydispersive | 1.00 | 50 |
| 8 | Exemplified compound (22) | Monodispersive | 0.45<br>0.20 | 0.15<br>0.16 | Monodispersive | 1.00 | 0.18 |
| 9 | Exemplified compound (46) | Polydispersive | 0.45<br>0.20 | 45<br>40 | Polydispersive | 1.00 | 50 |
| 10 | Exemplified compound (46) | Monodispersive | 0.45<br>0.20 | 0.15<br>0.16 | Monodispersive | 1.00 | 0.18 |

| | | Development process (1) | | | Development process (2) | | | |
|---|---|---|---|---|---|---|---|---|
| Sample No. | Cyan coupler | Formed red color's Max. density | Formed red color's Min. density (cyan stain) | Residual silver | Formed red color's Max. density | Formed red color's Min. density | Residual silver | Remarks |
| 1 | Comparative cyan coupler C-1 | 1.68 | 0.35 | 110 mg/m$^2$ | 2.10 | 0.24 | 1 mg/m$^2$ | Comparative |
| 2 | Comparative cyan coupler C-1 | 1.72 | 0.31 | 15 | 1.95 | 0.25 | 0 | Comparative |
| 3 | Comparative cyan coupler C-2 | 1.69 | 0.33 | 120 | 1.80 | 0.26 | 1 | Comparative |
| 4 | Comparative cyan coupler C-2 | 1.75 | 0.31 | 13 | 1.95 | 0.25 | 0 | Comparative |
| 5 | Exemplified compound (11) | 2.10 | 0.26 | 95 | 2.01 | 0.18 | 0 | Comparative |
| 6 | Exemplified compound (11) | 2.35 | 0.12 | 1 | 2.35 | 0.12 | 0 | Invention |
| 7 | Exemplified compound (22) | 2.05 | 0.25 | 25 | 1.95 | 0.18 | 1 | Comparative |
| 8 | Exemplified compound (22) | 2.35 | 0.13 | 0 | 2.36 | 0.13 | 0 | Invention |
| 9 | Exemplified compound (46) | 2.01 | 0.20 | 35 | 2.15 | 0.17 | 1 | Comparative |
| 10 | Exemplified compound (46) | 2.36 | 0.14 | 0 | 2.35 | 0.14 | 0 | Invention |

As apparent from Table 1, Samples 1 to 4 show that their formed color's maximum densities in Development Process (1) are considerably lower than those in Development Process (2), and also show their large cyan dye losses.

On the other hand, in Samples 6, 8 and 10, there occur no cyan dye losses at all.

The formed red color's minimum densities (cyan stain) are also obviously smaller in the samples for the invention.

Further, the results show that also in Development Process (1) the samples for the present invention are excellent in the desilverability.

From the results described above the superiority of the present invention is evident.

What is claimed is:

1. A method for processing silver halide photographic light-sensitive material which comprises color developing an imagewise-exposed silver halide photographic light-sensitive material and then bleach-fixing said color developed light-sensitive material, said light-sensitive material comprising support having thereon a silver halide emulsion layer containing monodispersed silver halide particles and a photographic cyan coupler having the Formula [I]:

Formula [I]

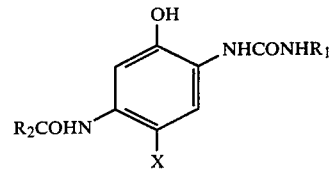

wherein X is a hydrogen atom or a radical that can be split off by the reaction of said coupler with the oxidized product of an aromatic primary amine color developing agent; $R_1$ is an aryl of a heterocyclic radical; and $R_2$ is a ballasting radical which provides non-diffusibility to said cyan coupler and a cyan dye formed therefrom, the monodispersed silver halide particles being such that the quotient of the standard deviation S of its silver halide particle sizes are defined in the following formula divided by the mean particle size $\bar{r}$ is not more than 0.20.

$$S = [(\Sigma[\bar{r} - ri]^2 ni)/\Sigma ni]^{\frac{1}{2}}$$

$$\frac{S}{\bar{r}} \leqq 0.20,$$

said "mean particle size" when the silver halide particle is in the globular form, means its diameter, or, when the particle is in the nonglobular form, means the mean value of the diameters of circles converted in equal sizes from its projected figures and when each individual particle size is ri and when the number of particles is ni, the $\bar{r}$ is as defined by the following formula:

$$\bar{r} = \frac{\Sigma ni\ ri}{\Sigma ni}.$$

2. The method for the processing of silver halide photographic light-sensitive materials as claimed in claim 1, wherein, in the Formula [I], $R_1$ is a naphthyl radical, a heterocyclic radical or a phenyl radical having at least one substituent selected from the group consisting of trifluoromethyl, nitro, cyano, —COR, —COOR', —$SO_2R$, —$SO_20R'$,

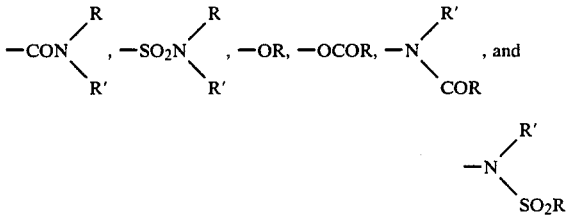

wherein R is an aliphatic radical or an aromatic radical; R' is a hydrogen atom, an aliphatic radical or an aromatic radical; and the R and R' are allowed to combine with each other to form a cyclic ring.

3. The method for the processing of silver halide photographic light-sensitive materials as claimed in claim 1, wherein said cyan couplers are the compounds each having the following Formula [Ia] or [Ib]:

Formula [Ia]

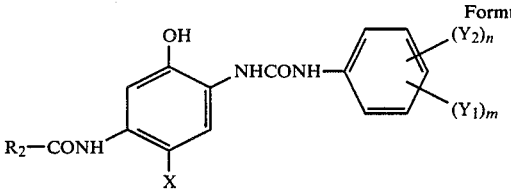

Formula [Ib]

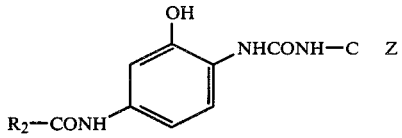

wherein $Y_1$ is trifluoromethyl, nitro, cyano or a radical represented by —COR, —COOR', —$SO_2R$, —$SO_2OR'$,

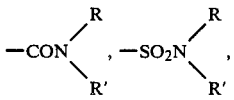

—OR, 13 OCOR, —NCOR or

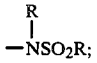

R is an aliphatic radical or an aromatic radical; R' is a hydrogen atom or the radical as defined in the R, the R and the R' being allowed to combine with each other to form a cyclic ring; $Y_2$ is a monovalent radical; m is an integer of from 1 to 3; n is an integer of up to 3; Z is a group of nonmetallic atoms necessary to form a heterocyclic radical or a naphthyl radical; $R_2$ represents an aliphatic or aromatic radical necessary to provide a nondiffusibility to the cyan coupler having Formula [Ia] or [Ib] and to the cyan dye formed from the same coupler; and X represents a radical synonymous with the X in the Formula [I].

4. The method for the processing of silver halide photographic light-sensitive materials as claimed in claim 3, wherein, in the Formula [Ia] or [Ib], the monovalent radical represented by the $Y_2$ is an aliphatic radical, an aromatic radical, a halogen atom, an amino radical, hydroxy or the radical as defined in the $Y_1$.

5. The method for the processing of silver halide photographic light-sensitive materials as claimed in claim 3, wherein, in the Formula [Ia] or [Ib], heterocyclic radical represented by Z is a 5- or 6- member heterocyclic ring containing from 1 to 4 nitrogen atoms, oxygen atoms or sulfur atoms.

6. The method for the processing of silver halide photographic light-sensitive materials as claimed in claim 3, wherein, in the Formula [Ia] or [Ib], the radical represented by $R^2$ necessary to provide nondiffusibility has the following Formula [Ic]:

Formula [Ic]

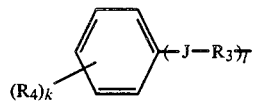

wherein J is an oxygen atom or a sulfur atom; k is an integer of 0 to 4; l is an integer of 0 or 1; provided when the k is an integer of not less than 2, the not less than two $R_4$s are allowed to be either the same as or different from each other; $R_3$ is a straight-chain or branched-chain alkylene radical having from 1 to 20 carbon atoms; R4 is a monovalent radical.

7. The method for the processing of silver halide photographic light-sensitive materials as claimed in claim 1, wherein the bleach-fix processing time is from 1 to 5 minutes.

8. The method for the processing of silver halide photographic light-sensitive materials as claimed in claim 1 wherein the silver halide particles are in the octahedral or tetradecahedral crystal form.

9. The method for processing of silver halide photographic light-sensitive materials as claimed in claim 1, wherein the silver halide is comprised substantially of silver iodobromide containing less than 12 mole % of silver iodide.

10. The method for the processing of silver halide photographic light-sensitive materials as claimed in claim 9, wherein the silver halide is comprised of silver iodobromide containing 1 to 8 mole % of silver iodide.

11. The method for the processing of silver halide photographic light-sensitive materials as claimed in claim 1, wherein the quantity of silver of the monodispersed silver halide particles contained in the silver halide emulsion layer is from 1.5 g/m$^2$ to 10.0 g/m$^2$.

12. The method for the processing of silver halide photographic light-sensitive materials as claimed in claim I, wherein the total amount of the silver of all the light-sensitive silver halide contained in the silver halide photographic light-sensitive material is from 5.5 g/m$^2$ to 115 g/m$^2$.

13. The method for the processing of silver halide photographic light-sensitive materials as claimed in claim 1, wherein the cyan couplers are added into a silver halide emulsion layer in the amount of $2^2 \times 10^{-2}$ to $5 \times 10^{31\ 1}$ mole per mole of the silver contained in the emulsion layer.

14. The method for the processing of silver halide photographic light-sensitive materials as claimed in claim 1, wherein a bleaching agent used in the bleach-fix bath is a metallic complex salt of an organic acid selected from the following organic acids:

ethylenediaminetetraacetic acid,
diethylenetriaminepentaacetic acid,
ethylenediamine-N-(β-oxyethyl)-N,N',N'-triacetic acid,
propylenediaminetetraacetic acid,
nitrilotriacetic acid,
cyclohexanediaminetetraacetic acid,
iminodiacetic acid,
dihydroxyethylglycine,
ethyl-ether-diaminetetraacetic acid,
glycol-ether-aminetetraacetic acid,
ethylenediaminetetrapropionic acid,
phenylenediaminetetraacetic acid,
disodium ethylenediaminetetraacetate,
tetra(trimethylammonium) ethylenediaminetetraacetate,
tetrasodium ethylenediaminetetraacetate,
pentasodium diethylenetriaminepentaacetate,
sodium ethylenediamine-N-(β-oxyethyl)-N,N',N'-triacetate, and
sodium propylenediaminetetraacetate.

15. The method for the processing of silver halide photographic light-sensitive materials as claimed in claim 1, wherein the bleaching agent is used in the amount of not less than 0.05 mole per liter of the bleach-fix liquid.

16. The method for the processing of silver halide photographic light-sensitive materials as claimed in claim 1, wherein the contents of the fixer in the bleach-fix liquid are 50 g to 100 g per liter of the bleach-fix liquid.

17. The method for the processing of silver halide photographic light-sensitive materials as claimed in claim 1, wherein the bleach-fix liquid is used at the pH value of from not lower than 7.0 to not higher than 8.5.

18. The method for the processing of silver halide photographic light-sensitive materials as claimed in claim 1, wherein the bleach-fix bath is used at a temperature of not higher than 55° C. to restrain the evaporation of the bath.

* * * * *